United States Patent [19]

Swint

[11] Patent Number: 4,526,356

[45] Date of Patent: Jul. 2, 1985

[54] INSERT MECHANISM FOR FLEXIBLE MULTIPLE SHEET TABLOID AND ADVERTISING PUBLICATIONS

[75] Inventor: Ronnie K. Swint, Emporia, Kans.

[73] Assignee: Kansa Corporation, Emporia, Kans.

[21] Appl. No.: 641,059

[22] Filed: Aug. 15, 1984

[51] Int. Cl.[3] ..... B65H 5/30

[52] U.S. Cl. ..... 270/55; 270/57

[58] Field of Search ..... 270/55, 57, 58

[56] References Cited

U.S. PATENT DOCUMENTS

| | | | |
|---|---|---|---|
| 3,420,576 | 1/1969 | Guggisberg | 270/55 |
| 3,527,455 | 9/1970 | Reist | 270/55 |
| 3,627,302 | 12/1971 | Dutro | 270/55 |
| 3,656,738 | 4/1972 | Glaser et al. | 270/58 |
| 3,663,007 | 5/1972 | Preiter | 270/55 |
| 4,373,710 | 2/1983 | Hansen et al. | 270/55 |
| 4,478,399 | 10/1984 | Morin | 270/55 |

*Primary Examiner*—E. H. Eickholt

*Attorney, Agent, or Firm*—Schmidt, Johnson, Hovey & Williams

[57] ABSTRACT

An insert mechanism particularly suitable for opening multiple page, folded, flexible, lightweight "shopper" type paper publications is disclosed which utilizes a pointed pin movable through an arc relative to the path of travel of the paper section which causes the pin to penetrate and lift only a portion of the sheets on the leading corner of the section remote from the fold while the section is advanced along a transport device. The pin is radially secured to a wheel, and the wheel rotates in timed relationship to the advancement of the leading corner of the folded paper. As the pin travels through its arc, it raises the lifted portion of the sheets to a position above a proximal separation shelf. An intermittent air stream directed towards the pin separates and directs downwardly any sheets lifted but not penetrated by the pin. As the section continues to advance on the transport device, the leading corner of the section is disengaged from the pin by a stripper finger, and the corner then falls to the separation shelf. The shelf is of a configuration to further separate the lifted portion from the remaining lower sheets as the section advances, and consequently additional sheets or other materials can readily be inserted within the opened section.

16 Claims, 7 Drawing Figures

INSERT MECHANISM FOR FLEXIBLE MULTIPLE SHEET TABLOID AND ADVERTISING PUBLICATIONS

BACKGROUND OF THE INVENTION

1. Field of the Invention

Our present invention relates to a device capable of opening relatively flexible, folded newspapers and advertising publications to enable the insertion of additional pages or sections.

2. Description of the Prior Art

Newspaper sections and advertising tabloids generally consist of a plurality of flat, identically-sized sheets of paper, wherein the sheets are folded within the next contiguous sheet such that a common centerfold is produced. However, often additional pages, flyers or other materials must be inserted within the section subsequent to the original assembly of the section. In some cases, not all of the sheets intended to be placed within the section are printed at the same time. In other cases, advertising flyers and smaller inserts are printed at a different location and must be placed within the section as soon as the latter is printed. In the past, these inserts have typically been stuffed into a newspaper section by hand. However, this operation is troublesome, labor intensive and time-consuming, causing the price of the final product to increase accordingly.

One apparatus which has attempted to overcome these difficulties is of the type illustrated in U.S. Pat. No. 3,627,302, issued to Lyle Dutro. The apparatus comprises a supporting bed adapted to receive the newspaper sections from a supply section. Each section is pushed individually along the bed on a horizontal axis by a pusher peg. A rotating sucker wheel overlying the bed is designed to lift the top half of the section and, while the section continues to advance, the sucker wheel then releases the top half of the section onto a supporting shelf immediately downstream of the sucker wheel. As the section continues to advance on the bed, additional pages can be inserted below the overhanging shelf in the opened section while the upper half of the section travels on the top surface of the shelf.

In particular, the rotating sucker wheel is positioned to engage a leading corner of the newspaper section and employs a subatmospheric pressure source to lift a free edge of the section. Because a large newspaper section is folded twice, with a common centerfold between the pages and also a second, subsequent fold perpendicular to the centerfold, the sucker wheel lifts the section on a free corner of the centerfold at a position remote from the second fold. As a result, the sucker wheel opens the section to its center and drops the top half of the section on the shelf as the section continues to advance. However, where the section comprises a smaller tabloid or "shopper" type publication, the sucker wheel cannot perform satisfactorily. These type of publications have only one fold, and consequently the sucker wheel is functional to lift only the top page of the section.

SUMMARY OF THE INVENTION

The present invention overcomes many of the disadvantages of the prior art. The insert mechanism can successfully open very flexible, multiple page newspaper sections and advertising tabloids of various sizes and thicknesses having only one centerfold.

More specifically, the present insert mechanism utilizes a transport device which horizontally advances a paper section along the direction of its centerfold. A pin, mounted on a rotatable wheel, penetrates a portion of the sheets on the leading corner of the section remote from the centerfold. As the paper section continues to advance, the wheel rotates and the pin moves upwardly through an arc, lifting the portion of the section penetrated by the pin. Next, a stripper finger extracts the lifted portion from the pin and the portion falls onto a proximal separation shelf. As the section continues to advance, additional pages, sections or other materials may be readily inserted within the opened section utilizing automatic insertion equipment if desired for this purpose.

The invention works particularly well with lightweight newsprint stock. Smaller tabloid and "shopper" publications, for example, are often printed on lightweight, very flexible stock having little or no body which is less costly to purchase and also has less weight and consequently has a much lower mailing cost. In particular, normal newsprint generally weighs 30-32 pounds per ream, with a ream being defined as 500 sheets of paper having the dimensions 24×36 inches. However, "shopper" publications are often printed on stock weighing only about 24 pounds per ream. This lightweight stock is difficult to handle on a transport device, because the very flexible pages tend to fly upward during movement and consequently cause a misfeed of the entire section. Furthermore, the longitudinal fiber grain of the paper in these smaller tabloids is parallel to the centerfold, causing the sheets to be difficult to open because the pages tend to collapse toward their normally closed position. However, our insert mechanism is capable of opening a flexible tabloid without losing control of the sheets, thereby avoiding misfeed of the entire section even at relatively high speeds along the transport device.

IN THE DRAWINGS

DETAILED DESCRIPTION

Figure 1:
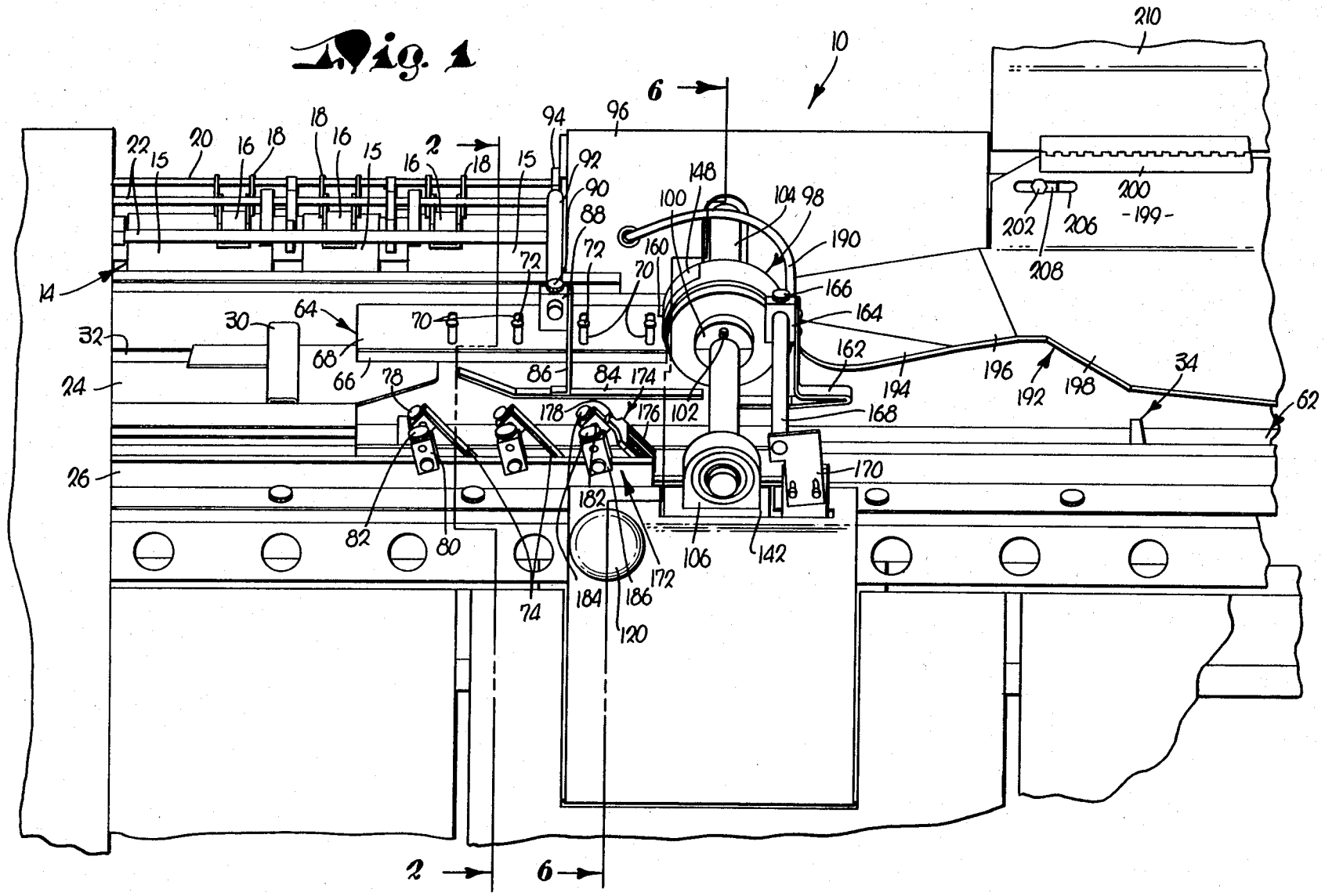
FIG. 1 is a side elevational view of our insert mechanism made in accordance with our present invention.

The insert mechanism of this invention in its preferred embodiment is shown essentially in FIG. 1 and broadly designated by the numeral 10. The insert mechanism 10 generally overlies a transport device broadly designated by the numeral 12 of the type illustrated in, for example, U.S. Pat. No. 3,656,738 to Glaser, et al., and which will hereinafter be referred to in more detail.

The insert mechanism 10 is operable to open a folded paper section 13. The paper section 13 is comprised of a plurality of flat, identically-sized sheets of paper, wherein the sheets are folded within the next contiguous sheet such that a common centerfold is produced.

While the insert mechanism 10 may be used to open full size newspaper sections, it has been found that this invention is particularly suitable for handling the smaller tabloid publications such as the "throw away shopper" and other mass mailed advertising publications.

A feeding mechanism (not shown) delivers paper sections 13 individually and in spaced relationship to a conveyor 14 made up of three spaced, cooperable conveyor belts 15, such that the centerfold of the section 13 comprises the leading edge of the section 13 while in motion on the conveyor 14. Three arms 16 overlie respective conveyor belts 15 and are freely pivotal on a set of brackets 18 adjustably attached to a shank 20. The arms 16 lightly engage the top of the section 13 during movement along the conveyor 14 and prevent the sheets of the section 13 from flying up and losing their generally folded, flat configuration. Additional paper section hold-down means (not shown) may also be strategically mounted on a pair of bars 22 when necessary.

Figure 2:
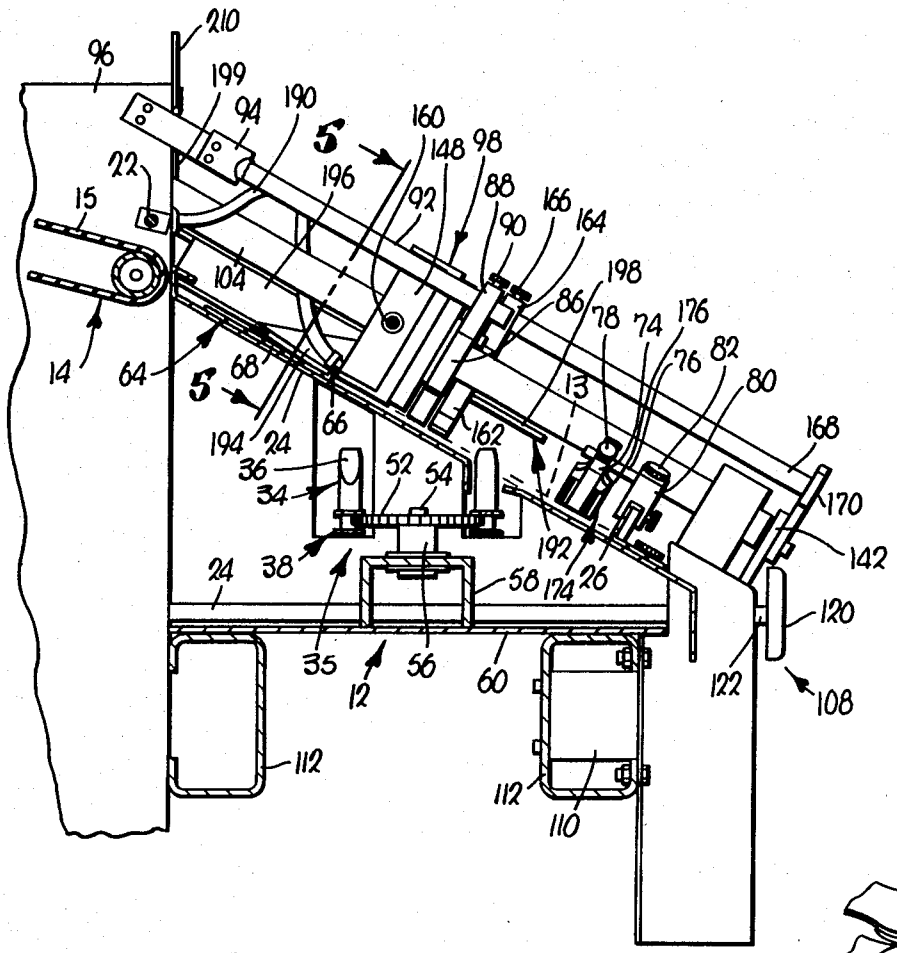
FIG. 2 is a cross-sectional view taken along line 2—2 of FIG. 1.

As the section 13 approaches the lower end of movement thereof along the conveyor 14, as best seen in FIG. 2, the section 13 falls from the conveyor 14 and contacts an inclined flat bed 24, whereupon the section 13 slides downwardly until its centerfold engages an elongated curb 26. The transverse cross-section of the curb 26 is L-shaped, one leg of which projects upwardly at an angle perpendicular to the bed 24 and the other leg of which extends downwardly, engaging the bed 24 and adjustably secured to the latter by a number of thumbscrews 28.

After the section 13 has traveled down the bed 24 and engaged the curb 26, an accelerator 30 engages an edge of the section 13 and pushes the latter in an advancing direction parallel to the longitudinal axis of curb 26. The accelerator 30 is reciprocably movable above a slot 32 and has means for reciprocation in timed relationship to the arrival of the section 13 at the curb 26.

Figure 4:
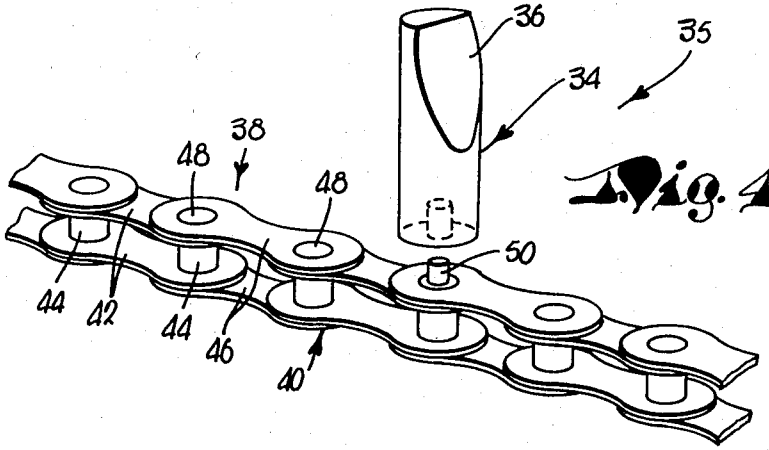
FIG. 4 is a fragmentary, enlarged, exploded view of the pusher peg and roller chain.

The accelerator 30 pushes the section 13 until the latter is within the path of travel of a respective pusher peg 34 of conveying mechanism broadly designated 35 having a series of such pegs located in spaced relationship a distance greater than the effective length of a paper section to be conveyed thereby. As best seen in FIG. 4, each of the pegs 34 has a flat face 36 inclined upwardly and rearwardly in relation to the advancing direction for engagement with the trailing edge of the paper section. The pegs 34 are mounted on an endless roller chain 38 of conventional construction comprising a series of links 40 having a pair of figure 8-shaped inner plates 42 connected in spaced relationship by a pair of sleeves 44. A pair of figure 8-shaped outer plates 46 pivotally join adjacent links 40 by pins 48 thereon which extend through the sleeves 44. Certain of the pins 48 have an extension 50 which complementally engages a bore in the pusher pegs 34 to attach the latter to the roller chain 38.

Figure 6:
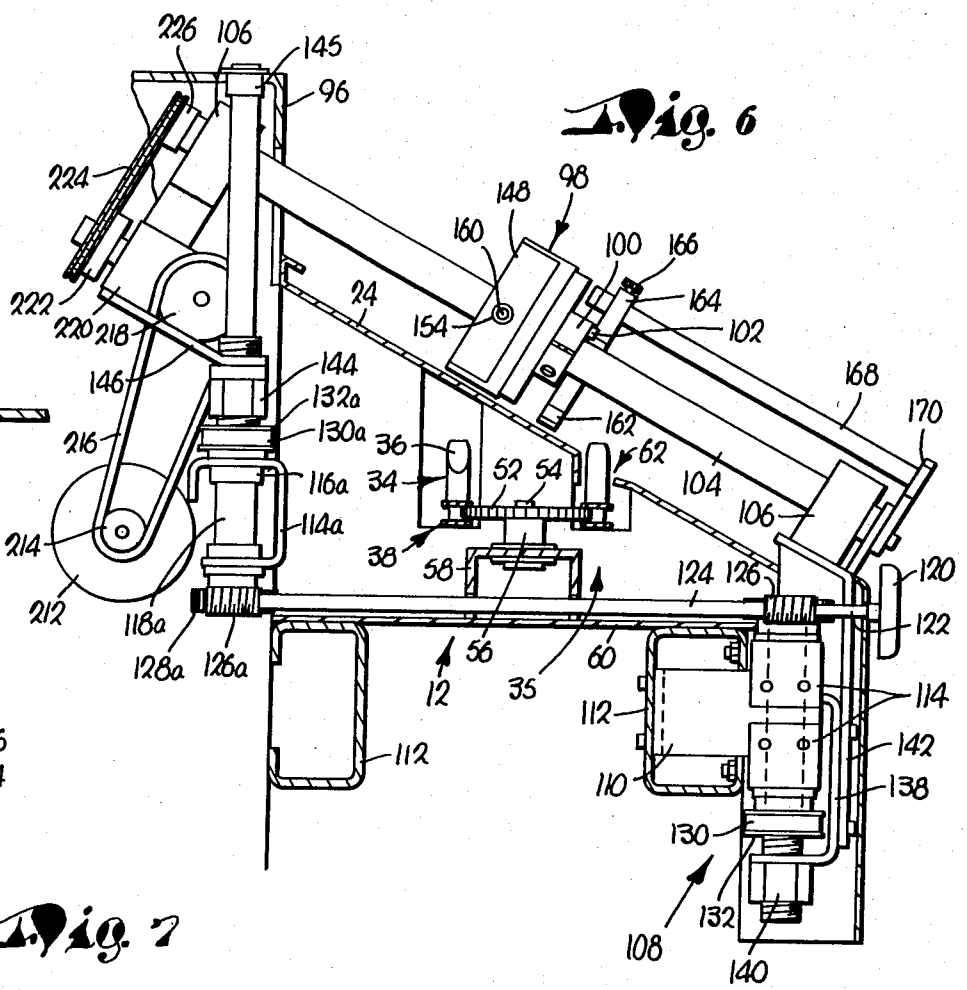
FIG. 6 is transverse cross-sectional view taken substantially along line 6—6 of FIG. 1.

As best seen in FIGS. 2 and 6, the roller chain 38 travels horizontally around a pair of sprockets 52 having a drive means (not shown) capable of movement in timed relationship to other dynamic components of the insert mechanism 10, as will be described hereinafter. The sprockets 52 are each journaled on an axle 54 above a hub 56, which is attached to a frame 58 connected to a table 60. The pusher pegs 34 during passage along the paper section conveying portion of their path of travel, project upwardly through the bed 24 in an elongated slot 62 having a longitudinal axis parallel with the longitudinal axis of the curb 26, such that each face 36 engages the trailing edge of the section 13 and pushes a corresponding section 13 in the direction of advancement thereof. However, after the pegs 34 reach the end of their path of travel in the advancing direction within the slot 62, the pegs 34 return along a path below a higher portion of the inclined bed 24, thereby avoiding interference with the advancing paper sections.

Additionally, means are provided on transport device 12 to prevent each paper section 13 from twisting, flying open, and otherwise losing its generally folded configuration. An elongated guard 64 of L-shaped transverse configuration, has a lower leg 66 which extends upwardly at a right angle to the bed 24 for the purpose of retaining the upper edge and centerfold of the proximal section 13 in parallel relationship with the longitudinal axis of the curb 26. An upper leg 68 on the guard 64 engages the bed 24 and has four elongated slots 70. A fastener 72 extends downwardly through each of the slots 70 and into the bed 24, such that the guard 64 may be releasably clamped in any one of a number of positions, corresponding generally to the width of the section 13. Additionally, a pair of elongated straps 74 are each adjustably connected to a rod 76 by means of a thumbscrew 78. A block 80, attached to the curb 26, has a thumbscrew 82 which adjustably engages the rod 76. As a result, the straps 74 extend downwardly to any one of a number of preselected positions and prevent the upper sheets of the section 13 from flying open. Also, a hold-down 84 is positioned over the bed 24 between the guard 64 and the straps 74. A rearward portion of the hold-down 84 is inclined upwardly away from the bed 24 while the forward portion of the hold-down 84 is generally parallel to the bed 24. A bar 86, attached to the center of the hold-down 84, extends upwardly from the latter and is fastened to a block 88. A thumbscrew 90 adjustably clamps the block 88 against a rod 92 which is welded to an element 94 attached to one side of a housing 96. As a result, the position of the hold-down 84 is modifiable according to the thickness of the paper section such that the upper sheets of the section 13 will not fly open.

A pin-type, cylindrical paper section opener wheel 98 has a collar 100 extending from one end thereof. A screw 102 threaded through a mating bore of the collar 100 secures the opener wheel 98 to an elongated, transversely circular shaft 104. A pillow block 106 is connected adjacent each end of the shaft 104, allowing the opener wheel 98 and the shaft 104 to rotate about an axis parallel to the bed 24 and perpendicular to the curb 26.

Figure 7:
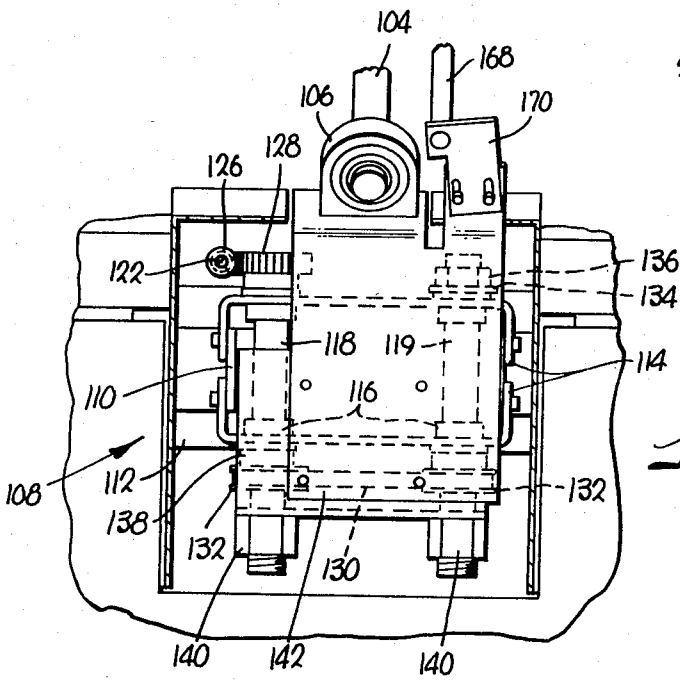
FIG. 7 is a fragmentary, side elevational view illustrating components of the opener wheel lifter apparatus.

The opener wheel 98 and the shaft 104 are vertically reciprocably movable by means of a lifter apparatus, broadly designated by the numeral 108. As seen in FIGS. 6 and 7, the lifter apparatus 108 is attached to the transport device 12 by a pair of L-shaped plates 110, one leg of each being connected to a beam 112 mounted below the table 60. The other leg of the plate 110 extends outwardly to engage two vertically-spaced C-shaped members 114. A pair of flanged sleeves 116 are threaded through horizontally-spaced holes in each of the members 114 and two vertical, cylindrical shanks 118, 119 are rotatably disposed respectively within a left-hand and a right-hand pair of the vertically-opposed sleeves 116, viewing FIG. 7.

As best seen in FIG. 6, a handle 120 is attached by means of an extension 122 to an elongated, transversely circular shaft 124 having a worm 126 on each end thereof. Viewing FIG. 7, the worm 126 drives a worm gear 128 fixedly coupled to the upper end of the shank 118 on the left of FIG. 7. The shank 118 rotatably drives the shank 119 by means of an endless belt 130 connected to a pulley 132 attached to a lower portion of each of the shanks 118, 119. A washer 134 and a nut 136, threaded onto the upper portion of the shank 119, holds the latter within the sleeves 116. A C-shaped frame 138 has an upper pair of holes slidable on the shanks 118, 119, and a lower pair of holes each aligned with a threaded nut 140, wherein the nuts 140 are attached to the frame 138 and are disposed on mating threads on the lower end of the shanks 118, 119. A support 142 is connected to the frame 138 and extends upwardly to support the lower pillow block 106. Thus, as the handle 120 is turned, worm 126 drives worm gear 128, correspondingly rotating shank 118, which, in turn, rotates shank 119 by means of the belt 130 connected to the pulleys 132. As the shanks 118, 119 rotate, the nuts 140, being attached to the frame 138 and therefore unable to turn, raise or lower the frame 138 which, accordingly, raises or lowers support 142.

The lifter apparatus 108 on the left-hand side of FIG. 6 operates in similar fashion to the lifter apparatus 108 on the right-hand side of FIG. 6, as previously described. Thus, the worm 126*a* on the left-hand side of the shaft 124 drives a worm gear 128*a* attached to the lower end of a shank 118*a*, the latter rotatable within a pair of sleeves 116*a* mounted within a member 114*a*. As the shank 118*a* rotates, a belt 130*a* connected to a pulley 132*a* on the shank 118*a* causes a pulley 132*a* mounted on a shank 119*a* (not shown) to simultaneously rotate. The shanks 118*a*, 119*a* are each supported adjacent their upper end by a bushing 145 mounted in the housing 96. A nut 144, having a bore complementally threaded to the upper portion of the shank 118*a*, 119*a*, is fixed to a support 146, the latter supporting the upper pillow block 106. Again, as the shanks 118*a*, 119*a* rotate, the nuts 144, being fixed to the support 146, cause the latter to raise or lower depending upon the rotation of the handle 120.

Consequently, when handle 120 is rotated in a clockwise manner, viewing FIG. 1, the shanks 118, 119, 118*a* and 119*a* will also rotate clockwise, looking downward from a view above the transport device 12, causing the supports 142, 146, to raise the pillow blocks 106, correspondingly causing the opener wheel 98 and the shaft 104 to move upwardly from the bed 24. Similarly, when the handle is rotated counterclockwise, the opener wheel 98 and the shaft 104 move downwardly toward the bed 24.

A generally semicircular pin holder 148 is secured to a recess within the opener wheel 98 by two allen screws 150. The pin holder 148 has a cavity 152, and a threaded bore 154 extends radially outward through the cavity 152. A bolt 156 having threads complemental to the bore 154 is mounted within the latter and retained in position by a spring 158. A small, pointed pin 160, connected to the outer end of the bolt 156, extends radially outward from the pin holder 148. As a result, the pointed end of the pin 160 may be selectively moved radially toward and away from the opener wheel 98 to any one of a number of preselected positions.

An elongated metal stripper finger 162 is adjustably secured over the transport device 12. The stripper comprises a V-shaped portion generally pointing in the direction of advancement of the paper section and is provided with an upper leg connected to a generally upright portion and a lower leg connected to a rearward portion generally parallel to the bed 24. The upright portion of the stripper 162 is secured to a block 164 having a thumbscrew 166 which adjustably clamps the block 164 to an elongated rod 168. The lower end of the rod 168 is attached to a standard 170, which, in turn, is adjustably secured to the support 142. As a result, the stripper is adjustably movable to any one of a number of preselected positions along three axes: an axis parallel to the paper section advancing direction, an axis parallel to the longitudinal axis of the leading edge of the section 13, and an axis perpendicular to the plane of the bed 24.

Furthermore, restraint means generally designated by the numeral 172 may conveniently comprise a brush 174 having a plurality of bristles 176 extending downwardly a distance to engage the upper face of a paper section therebelow, and an upper, narrow handle portion 178. A block 180, attached to the upper end of the handle portion 178, is adjustably connected to a rod 182 by means of a thumbscrew 184. The rod 182 is attached to a second block 186 by means of another thumbscrew 184, and the block 186 is mounted on an upper portion of the curb 26. Thus, the restraint means 172 may be adjusted by the machine operator to any one of a number of fixed, preselected positions.

Figure 3:
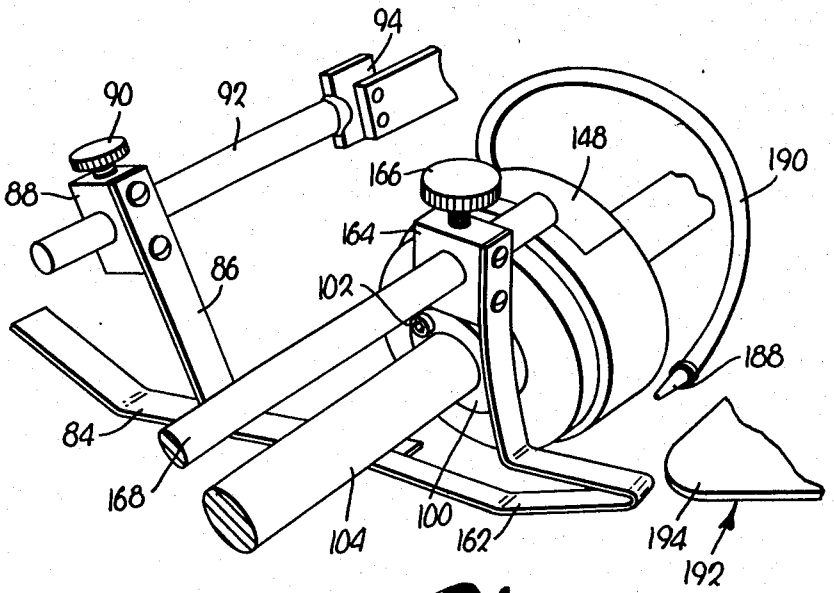
FIG. 3 is an enlarged, fragmentary, perspective view of the opener wheel, stripper, separation shelf and hold-down strap.
Figure 5:
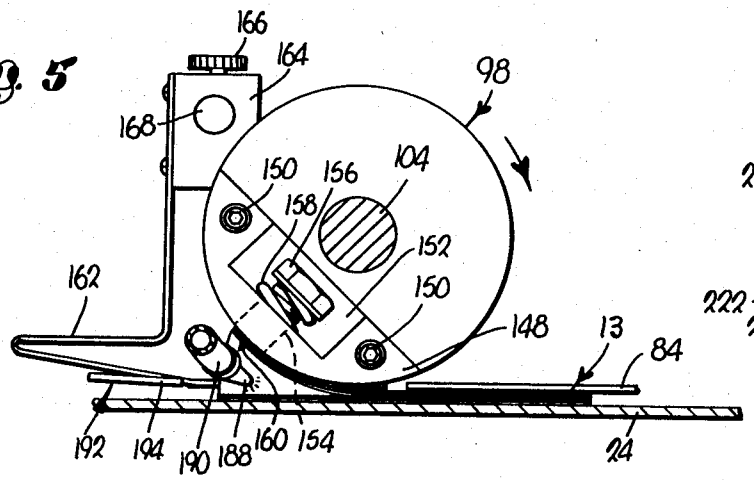
FIG. 5 is a fragmentary, cross-sectional view taken along line 5—5 of FIG. 2.

As seen in FIGS. 3 and 5, an air nozzle 188 is positioned to direct a relatively low volume air stream toward the leading corner of the section 13 remote from the centerfold as the section 13 advances along the transport device 12. The air nozzle 188 is supported on the end of an air hose 190, the latter having an outer shell of sufficient rigidity to retain the position of the air nozzle 188. Means (not shown in detail) is provided for regulating the duration, timing and volume of the air stream emanating from the air nozzle 188.

Disposed immediately downstream of the opener wheel 98 is a separation shelf 192. The separation shelf 192 is comprised of three integral flat portions: a nose portion 194, a transition portion 196, and a downstream portion 198. As seen in FIG. 5, the nose portion 194 lies in close proximity to the opener wheel 98, the air nozzle 188 and the stripper 162. The transition portion 196 is inclined upwardly in the paper section advancing direction from the nose 194 and connects the latter to the downstream portion 198. The downstream separation portion 198 extends along the transport device 12 in a plane generally parallel to the bed 24. A rear segment 199 of the downstream portion 198 is folded upwardly and attached to an elongated hinge 200. Also, a bolt 202 is threaded through a pair of nuts (not shown), the nuts engaging the rear segment 199 over a slot 206. The threaded end of the bolt 202 bears against a plate 208 attached to the housing 96 such that the separation shelf 192 may be pivotally moved around the hinge 200 as the pair of nuts are turned on the threaded bolt 202. Additionally, a plate elongated guard 210 of generally L-shaped transverse configuration, is also pivotally movable around the hinge 200. The guard 210, although shown in FIG. 1 in a retracted, upright position, is generally lowered during use to a position horizontally spaced above the separation shelf 192, such that air currents are precluded from disturbing the configuration of the advancing paper section 13. A plurality of tabs (not shown) on the guard 210 engage the rearward segment 199 and hold the guard 210 in spaced relationship to the shelf 192. Although not specifically illustrated, it is to be understood that the hinge 200 has an elongated internal pin which is attached to the plate 208, thereby holding the shelf 192 and the guard 210 in spaced relationship from the bed 24.

An electric motor 212 is coupled to a sprocket 214, which engages a drive train 216 connected to another sprocket 218 on one side of a reducing angle drive 220. Another sprocket 222, mounted on the other side of angle drive 220, couples a drive chain 224 and another sprocket 226 with the latter being affixed adjacent the upper end of the shaft 104. The motor 212 and the angle drive 220 are mounted on the vertically reciprocable support 146, and therefore accompany the shaft 104 and the opener wheel 98 as the handle 120 is turned.

In addition, another set of sprockets, drive chains, and a reducing angle drive (all not shown) couple the motor 212 to the sprocket 52, effecting horizontal movement of the pusher pegs 34 along the bed 24. An idler sprocket (not shown) removes slack in the drive chain yet permits the vertical movement of the motor 212 upon the lifter apparatus 108. Additionally, not shown, is clutch means for effecting rotatable movement of the opener wheel 98 in timed relationship to the advancement of the section 13 along the transport device 12.

OPERATION

In use, each paper section 13 is successively delivered to the conveyor 14 and progresses downwardly along the length of the latter. The arms 16 lightly bear against the upper sheets of the section 13 to keep the pages from opening. As the lower end of the conveyor 14 is reached, the section 13 falls, engages the bed 24 and then slides downwardly until the centerfold of the section 13 contacts the curb 26, as shown by the dotted line position in FIG. 2.

The accelerator 30 is timed to begin movement of the section 13 in a generally horizontal direction parallel to the longitudinal axis of the curb 26 once the centerfold engages the curb 26. The accelerator 30 pushes the section 13 until the trailing edge of the latter is picked up by an adjacent pusher peg 34. Next, the accelerator moves rearwardly to await the arrival of the next paper section 13. Simultaneously, the pusher peg 34 continues advancement of the paper section 13 along the transport device 12. The guard 64, the straps 74, and the hold-down 84 retain the section 13 against the bed 24, prevent the upper sheets from flying upwardly and generally maintain the longitudinal axis of the centerfold in a direction parallel to the advancing direction.

As the section 13 continues its forward travel, the leading corner of the section 13 remote from the centerfold approaches the opener wheel 98. The opener wheel 98 rotates in timed relationship to the advancement of the section 13 sure that the pin 160 penetrates a portion of the sheets within the section 13 on the leading corner. The opener wheel 98 may be adjustably moved toward and away from the bed 24 by means of the lifter apparatus 108, as previously described, to allow for proper sheet penetration depth of the pin 160, corresponding to the thickness of the section 13. Also, the bolt 156 may be radially adjusted within the pin holder 148 to further adjust the depth of penetration of the pin 160.

After the pin 160 penetrates the leading corner of the section 13, and as the section 13 advances, the opener wheel 98 continues to rotate and the pin 160 lifts the portion of the sheets penetrated by the pin 160 as illustrated in FIG. 5. The air nozzle 188 projects a timed, intermittent, low volume air stream toward the pin 160 to separate and direct downwardly any sheets lifted but not penetrated by the pin 160 from the portion of the section 13 actually penetrated by the pin 160. As a result, these loose sheets are flattened against the remaining, lower sheets of the section 13.

In addition, the restraint means 172 is positioned such that the bristles 176 engage the top of the section 13 as the pin 160 engages and lifts the leading corner. Because the opener wheel 98 is rotated at a speed to cause the pin 160 thereon to move at a slightly faster linear velocity than the horizontal velocity of the pusher pegs 34 and the strategic location of the restraint means 172, the pin 160 remains in tight gripping engagement with the leading corner of the paper section 13, and there is no tendency for the section 13 to lose its generally folded configuration.

As the section 13 continues to advance, and as the opener wheel 98 continues to lift the leading corner, the section 13 contacts the bottom of the stripper 162. As the section 13 continues to advance, and the leading corner is lifted higher, the stripper 162, being positioned between the opener wheel 98 and the curb 26, pushes against the top of the section 13 until the upper portion penetrated by the pin 160 is released from the latter. At this time, however, the upper portion is now positioned above the proximal nose 194 of separator 192 and thus drops onto the latter.

As the section 13 continues to advance, the upper portion of the section 13 now slides along the top of the separation shelf 192 while the remaining sheets slide therebeneath along the bed 24. Subsequently, the upper portion of the paper section 13 slides across the transition portion 196 which, by virtue of its inclined configuration, raises the upper portion higher until it reaches the downstream separator portion 198. The upper portion of the section 13 is now at a position sufficiently away from the remaining sheets of the section 13 to permit additional sheets of paper to readily be inserted within the opened section 13 between the upper portion and the lower, remaining sheets below. As the section 13 continues to advance along the downstream portion 198, automatic supply means (not shown) inserts additional sheets of paper or other materials into the opened section between the separation shelf 192 and the lower portion of the section 13 sliding along the bed 24. Alternatively, the additional insert sections can be fed by hand if desired. The guard 210 prevents any air currents from disturbing the upper sheets. Simultaneously, the opener wheel 98 rotates to a position whereupon the clutch means suspends the rotating motion and the opener 98 thus awaits arrival of the next advancing section.

It can now be appreciated that insert mechanism 10 is able to efficiently process folded paper sections. Because the section 13 is penetrated and lifted mechanically by a pin, it is possible to more precisely control the number of lifted pages of the section 13 than has heretofore been known. Also, the absence of a subatmospheric sucker wheel precludes the operating and maintenance difficulties commonly encountered with the latter.

The insert mechanism 10 can open folded paper sections to approximately the center of the section regardless of the number of sheets comprising the latter. The depth of penetration of the pin 160 into the paper section is selected by adjusting the radially movable belt 156 which secures the pin 160. Also, to compensate for the thickness of the paper section 13, the lifter apparatus 108 enables the opener wheel 98 to be disposed in any one of a number of preselected positions above the bed 24. Thus, by adjustment of both the belt 156 and the lifter apparatus 108, the pin 160 can penetrate to the middle of the folded paper section 13 regardless of the thickness of the latter. Noteworthy is the fact that it is not necessary to open the folded paper section 13 to its exact centerfold; as long as the paper section 13 is opened near its center, materials subsequently inserted will safely be maintained in position until delivery to the ultimate consumer has been completed. By comparison, the best result possible under the prior art has been the lifting of only the top sheet of paper, which obviously will not satisfactorily permit the section to secure and carry inserted materials within.

Another important aspect of the invention is the controlled speed differential between the linear velocity of section 13 and the arcuate velocity of the paper penetrating point of pin 160. While the paper advances 12 inches along the bed 24, the point 160 moves a distance equivalent to 13.302 lineal inches. This differential speed between the pin 160 and the section 13 has been found to make a significant difference during operation. Because the pin 160 is moving slightly faster than the section 13, the pin 160 will pull on the leading corner and properly lift the portion of the sheets penetrated by the pin. Simultaneously, the restraint means 172 prevents the section 13 from moving linearly at the arcuate speed of pin 160. Consequently, although the hole created by the pin penetration may become insignificantly elongated, the upper portion of the sheets penetrated remains in tight engagement with the pin 160 and is thereafter positively lifted above the proximal nose 194 of separator 192.

Additionally, the tapered face 36 on the pusher pegs 34 enable the section 13 to be lifted and opened without the trailing edge of the section 13 dragging against the peg 34. As a result, when the leading portion of the section 13 is lifted, and advanced along the separation shelf, the rear portion of the section 13 can also open without frictionally engaging the face 36. This allows extended operation of the insert mechanism 10 without misfeeds, which materially delays processing and increases costs correspondingly.

Another important aspect of the invention is the configuration and location of the separation shelf 192. The nose 194 is in close proximity to the bed 24 such that the upper sheets of the section 13 need be lifted only a minimal distance. However, once the leading corner of the section 13 engages the nose 194, the section 13 thereupon encounters the upwardly inclined transition portion 196, which rapidly lifts the upper sheets of the section 13 to the height of the downstream portion 198. The downstream portion 198, generally lying in a plane parallel to the bed 24, is at a height such that additional sheets may be readily inserted. Consequently, while the section 13 is initially opened only a relatively small distance, as the section 13 advances along the separation shelf 192 the upper portion is rapidly lifted to a position for subsequent insertion of additional sheets of paper within the opened section.

It should now also be readily apparent that the lightweight, flexible paper commonly used in throwaway "shopper" type publications can readily be handled on the insert mechanism without difficulty. Because the restraint means 172 counteracts the forward pull of the pin 160, the section 13 is held against the bed 24 during forward motion and will retain its generally folded configuration even though the paper is highly flexible.

Also, the guard 64, the straps 74, and the hold-down 84 ensure that sections comprised of flexible, thin-bodied newsprint will not twist or open during advancement. Furthermore, the air stream emanating from the nozzle 188 propels any pages not penetrated by the pin downwardly towards the remaining sheets of the section 13, thereby avoiding the possibility that loose intermediate sheets in the section 13 could become tangled on the nose 194 of the separation shelf 192.

It is also to be understood that other forms of a stripper means may be employed. For example, the pin 160 can have means for automatic retraction into the opener wheel 98 as the section 13 is lifted, causing the upper portion of the section 13 to consequently fall onto the separation shelf 192. However, the metal stripper 162, as illustrated, has proven to be an inexpensive yet highly effective means for removing the lifted portion from the pin 160.

Other forms of our invention could embody a restraint means 172 alternatively having a plurality of rollers disposed upstream of the opener wheel 98. Also, a resilient strap may be utilized to yieldably bias the section 13 against the bed 24. However, the brush 174 with the bristles 176 has proven to be a successful means for restraining the section 13.

Having thus described the invention, what is claimed as new and desired to be secured by Letters Patent is:

1. A mechanism for opening a rectangular folded paper section, wherein the section comprises a plurality of folded, substantially identically-sized flat sheets of paper, the sheet being folded within the next contiguous sheet such that a common center fold is produced, said mechanism comprising:

a transport device for substantially horizontal movement of the paper section in an advancing direction generally parallel to the longitudinal axis of the center fold;

an elongated pin with a pointed end;

means for mounting the pin in disposition for movement through an arc, such that the pin is located to penetrate a portion of the sheets on the leading corner of the section remote from said fold as said leading corner approaches the pin, and to thereafter lift said portion of the sheets engaged by the pin as the section is advanced by the transport device;

means coupled to said pin for moving the latter relative to said transport device in timed relationship with advancement of the section;

stripper means for stripping said portion of the sheets from the pin after said portion is lifted; and means for holding the stripped portion released from said pin at a position away from the remaining sheets of the section, permitting additional sheets of paper to thereafter be inserted within the opened section between said portion and said remaining sheets.

2. The invention of claim 1, wherein said pin support means comprises a rotatable wheel having an axis of rotation parallel to the leading edge of said section when the section is advanced by said transport device, said pointed end of the pin being disposed in a radially outward direction from said wheel, and the lineal velocity of said rotating pointed end being at least as great as the horizontal velocity of the section on said transport device.

3. The invention of claim 2; and means for adjustably attaching said pin to said wheel, such that said pointed end may be selectively moved radially toward and away from said wheel to any one of a number of preselected positions.

4. The invention of claim 3; and means for adjustably moving said wheel toward and away from said transport device, wherein the depth of penetration of the pin into the section may be adjusted.

5. The invention of claim 4; and restraint means for yieldably biasing the section against the transport device as the pin penetrates and lifts said portion, providing tension on the section against the force presented by said pin to retain the generally folded configuration of the section.

6. The invention of claim 5, wherein said restraint means comprises a brush having a plurality of bristles, such that the free end of the bristles extends downwardly to engage the top of the section as the section moves along the transport device.

7. The invention of claim 2, wherein said stripper means comprises an elongated metal finger, adjustably secured over said transport means and movable to position to engage the lifted portion and release said portion of the sheets from the pin as said wheel continues to rotate.

8. The invention of claim 7, said stripper means being adjustably movable in a direction generally parallel to said advancing direction to any one of a number of preselected positions.

9. The invention of claim 7, said stripper means being adjustably movable in a direction generally parallel to the longitudinal axis of the leading edge to any one of a number of preselected positions.

10. The invention of claim 7, said stripper means being adjustably movable in a direction generally perpendicular to both the advancing direction and also the longitudinal axis of the leading edge to any one of a number of preselected positions.

11. The invention of claim 1; and means for directing a timed, low volume air stream toward said leading corner, such that any sheets lifted but not penetrated by the pin are separated from said portion of the sheet penetrated by the pin and directed downwardly toward the remaining sheets.

12. The invention of claim 1, wherein said means for holding open the section comprises a shelf overlying the transport device and proximally disposed to said pin, whereby said lifted portion of the sheets slidably engages the top of the shelf as the section is advanced.

13. The invention of claim 1, wherein said transport device has a plurality of upright pusher pegs for advancement of the section, said pegs each having a flat face for engagement with the trailing edge of the section, said face being inclined upwardly and rearwardly in relation to the advancing direction.

14. A method of opening a rectangular folded paper section, wherein the section comprises a plurality of folded, substantially identically-sized flat sheets of paper, the sheets being folded within the next contiguous sheet such that a common center fold is produced, said method comprising the steps of:

advancing the section in a direction generally parallel to the longitudinal axis of the center fold;

penetrating a portion of the sheets on a leading corner of the section remote from the center fold with a pin;

moving the pin in a direction as the section continues to advance to offset lifting of said portion of the sheets engaged by the pin;

stripping said portion of the sheets from the pin; and holding said stripped portion at a position away from the remaining sheets of the section, permitting additional sheets of paper to thereafter be inserted within the opened section between said portion of the sheets and said remaining sheets.

15. The method of claim 14, wherein said pin moving step includes directing the pin along a repetitive circular path.

16. A method of opening a rectangular folded paper section, wherein the section comprises a plurality of folded, substantially identically-sized flat sheets of paper, the sheets being folded within the next contiguous sheet such that a common center fold is produced, said method comprising the steps of:

advancing the section by a transport device in a substantially horizontal direction generally parallel to the longitudinal axis of the center fold;

penetrating a portion of the sheets on a leading corner of the section remote from the center fold with a pin supported on a rotatable wheel;

rotating the wheel in timed relationship with the advancement of the section portion;

projecting an intermittent air stream toward said pin to separate and direct downwardly any sheets lifted but not penetrated by the pin from said portion penetrated by the pin;

stripping said portion of the sheets from the pin; and holding said stripped portion on a shelf at a position away from the remaining sheets of the section, permitting additional sheets of paper to thereafter be inserted within the opened section between said portion and said remaining sheets.

* * * * *